United States Patent [19]

Brant

[11] Patent Number: 5,038,528

[45] Date of Patent: Aug. 13, 1991

[54] GASKET SEAL

[75] Inventor: Anthony W. Brant, Minesing, Canada

[73] Assignee: GSW Inc., Barrie, Canada

[21] Appl. No.: 520,742

[22] Filed: May 8, 1990

[51] Int. Cl.[5] ..... E02B 9/04; E04D 13/00

[52] U.S. Cl. ..... 52/11; 248/48.1

[58] Field of Search ..... 405/121–123; 52/11; 248/48.1, 48.2

[56] References Cited

U.S. PATENT DOCUMENTS

| | | | |
|---|---|---|---|
| 3,355,895 | 12/1967 | Bayes et al. | 52/11 |
| 4,242,829 | 1/1981 | Arnstrom | 52/11 |
| 4,257,716 | 3/1981 | Woodrow | 52/11 |
| 4,297,053 | 10/1981 | Nicholas | 405/121 |
| 4,305,236 | 12/1981 | Williams | 52/11 |
| 4,327,051 | 4/1982 | Edmondson | 405/121 |

*Primary Examiner*—James L. Ridgill, Jr.

[57] ABSTRACT

An eavestrough fitting according to the present invention comprises a moulded plastic member having an improved gasket secured thereto. The gasket has at least two ribs extending across the member and up the sides thereof with the ribs sized to form a seal with an appropriately shaped eavestrough inserted within the fitting. The moulded plastic member has a generally flat base connected to outwardly angled sidewalls which terminate in a short vertical section. The gasket conforms to the shape of the moulded plastic member and includes a raised land interior to the ribs. This raised land limits the extent of deformation of the ribs while providing a resilient base for supporting the eavestrough section within the fitting. The raised land allows the eavestrough section interior to the ribs to be in contact with the land and the lower surface of the eavestrough such that grit and other debris has less of a tendency to become lodged beneath the eavestrough section.

10 Claims, 2 Drawing Sheets

38
34
18
8
16
32
20
2
22
12
40
38
36
20
30
18
6
8
34
4
32
10
16
12
40
30
36

18
22
8
8
2
7

GASKET SEAL

FIELD OF THE INVENTION

The present invention relates to eavestroughing systems and particularly fittings for eavestroughing systems which utilize a gasket for sealing with eavestrough sections.

BACKGROUND OF THE INVENTION

A number of eavestrough sections are known which utilize extruded plastic eavestrough sections joined by plastic moulded fittings. These systems can generally be divided into two types, one type utilizes a gasket arrangement for sealing with the length of eavestrough and the second type uses a solvent seal for securing of the eavestrough section within the fitting. Examples of the gasket type system are shown in our corresponding U.S. Pat. 4,901,954 and U.S. Pat. 4,257,716.

With plastic eavestroughing systems, the plastic has a relative high coefficient of thermal expansion and thus the fitting must accommodate a substantial movement of the eavestrough section within the fitting. Any gasket system accommodates this thermal expansion by allowing the eavestrough section to slide therewithin. These gasket type systems generally have a raised rib or deforming member which engages the lower surface of the eavestrough and provides a seal therewith.

In our earlier patents, a number of ribs are shown which contact the lower surface of the eavestrough section and provide a series of wiper seals along the bottom thereof. With systems of this type, the wiper member is the one which projects highest from the actual base of the eavestrough fitting and, therefore, there is a gap beneath the eavestrough section interior to the ribs in which water and other debris may accumulate, reducing the effectiveness of the seal.

SUMMARY OF THE INVENTION

It has been found with the present invention that an improved gasket for eavestrough fittings is possible by providing, in combination with wiper seals or a deforming member, a raised land area interior to the seal which engages the bottom of the eavestrough section and thus eliminates or reduces the tendency for water and/or debris to accumulate under the lower surface of the eavestrough section. This land area not only provides protection to the bottom section of the eavestrough, but it also serves to allow the seals to merely perform their sealing function as opposed to a full load bearing capability without the land area. As can be appreciated, the land area is raised and actually provides the bottom support for the eavestrough section and the wiper seals can function without having to satisfy this support requirement. Thus, the extent of deformation of the seals and the manner in which the seals are deformed is known and better controlled.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
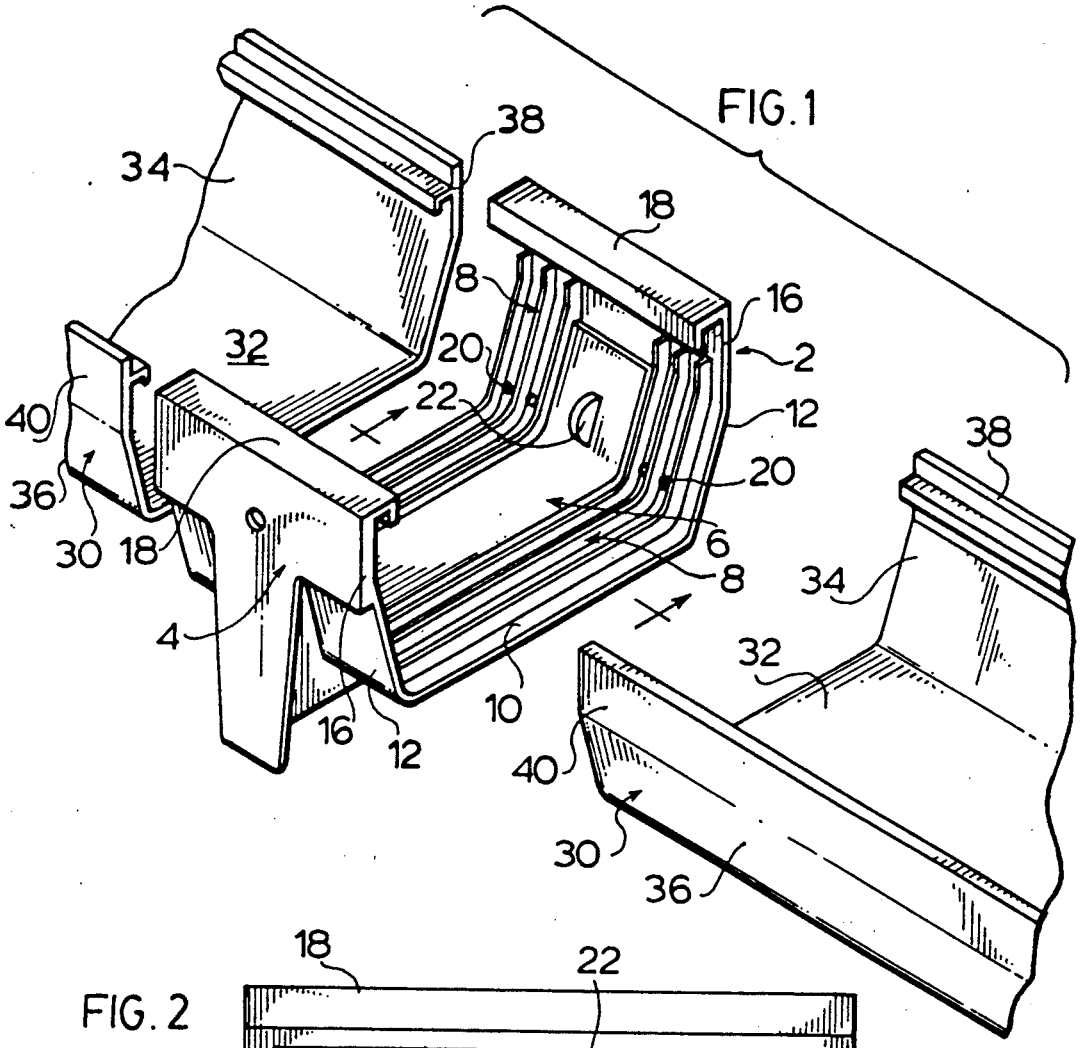
FIG. 1 is an exploded perspective view of the eavestrough fitting in combination with two lengths of eavestrough.

The eavestrough fitting 2 is shown as a joiner for joining of two lengths of eavestroughing, generally shown as 30, however it is typical of other fittings, i.e. end caps, drop spouts, center drops, corner drops, etc., all of which are known with respect to eavestrough sections. The being that the gasket shown in the joiner for engaging one length of eavestrough can be used in whatever fitting and duplicated if necessary.

The eavestrough fitting 2 includes a moulded plastic member 4 which has the gasket 6 secured on the interior surface thereof and with the gasket generally conforming to the shape of the moulded plastic member 4. Gasket 6 includes a central gasket base 7 with the three ribs or wiper seals 8 provided either side of the central gasket base 7. Thus, both the gasket 6 and the moulded plastic member 4 generally have a flat base 10 and outwardly angled sidewalls 12 and 14 which terminate in short vertical sections 16. The vertical sections 16 include at the upper edge thereof U-shaped retaining flanges 18. The flexible gasket 6 also includes resilient members 20, in this case in the form of circular tits, associated with the ribs generally between one-half inch and one inch above the base and either side of the base 10. The function of these resilient members is described in our copending application entitled "IMPROVED GUTTER SEAL". The gasket 6 also includes a moulded stop face 22. In the past, this stop face has been part of the rigid moulded plastic member 4, however, as it only provides an indication of the stop face, it is preferred that this member be made of the flexible gasket material as thermal expansion of the eavestrough section can in effect shear this portion if necessary or at least move therepast.

The eavestrough section 30 generally has a flat base 32, sidewalls 34 and 36 which are outwardly angled, with short vertical sections 38 and 40. Thus, the shape of the eavestrough section 30 generally corresponds with the interior shape of the moulded plastic member 4.

Figure 2:
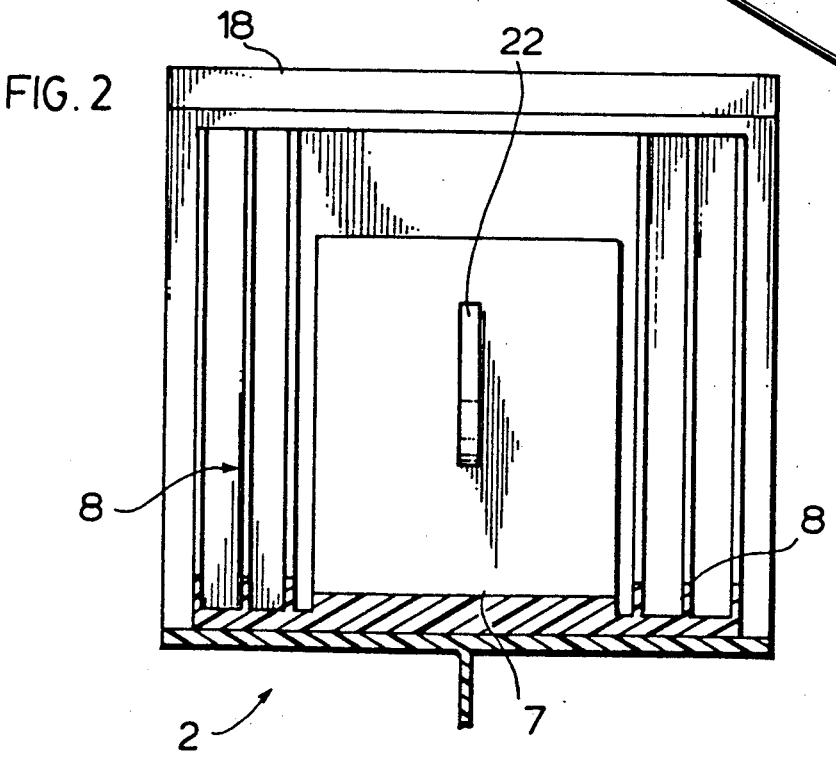
FIG. 2 is a vertical section through the center of the eavestrough fitting.

FIG. 2 illustrates how the central gasket base 7 defines a raised land area such that the ribs 8 will not provide the primary support for the eavestrough section which is inserted within the fitting. Thus, the central gasket base 7 contacts the eavestrough section 30, as in FIGS. 3 and 4, over a substantial surface of the eavestrough section and provides resilient support for the eavestrough section. The eavestrough section is snapped within the fitting preferably by placing one side of the eavestrough section 30 beneath the U-shaped retaining flange 18 and then applying downward pressure on the opposite side and eventually snapping the other edge of the eavestrough within the corresponding U-shaped flange on the opposite side of the fitting 4. This requires deformation of the gasket 6 and in particular, the central gasket base 7 which is possible due to the soft resilient material forming this gasket.

Figure 3:
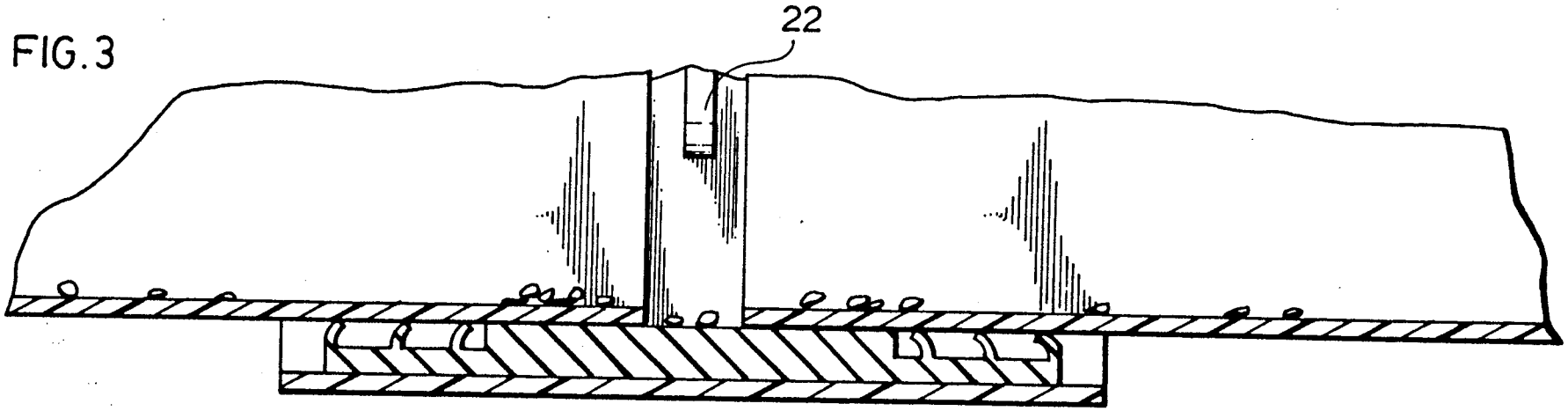
FIGS. 3 and 4 are vertical sectional views through a fitting engaging two lengths of eavestrough.
Figure 4:
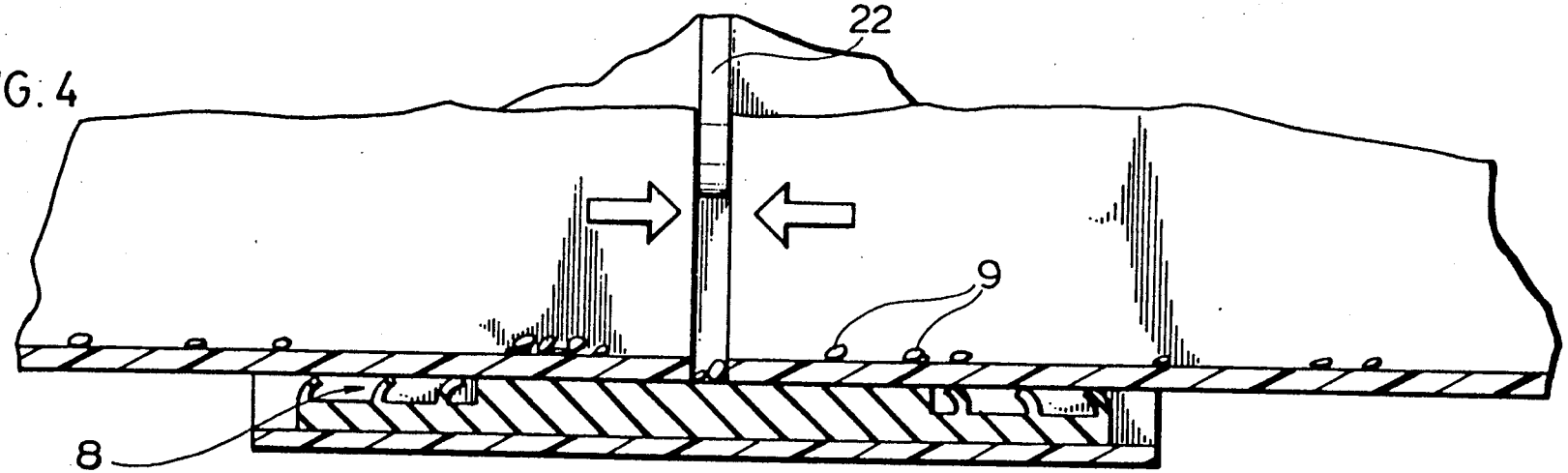

As shown in FIGS. 3 and 4, the central gasket base 7 has provided this support with only a minor extent of deformation of the ribs 8 allowing them full flexibility with respect to movement of the eavestrough sections 30. It is also clearly illustrated how the lower surface of the eavestrough section 30 is now contacted by the central gasket base 7 such that debris, generally indicated as 9, in this case in the form of grit from the shingles, cannot accumulate beneath the eavestrough section and contaminate the rib seals 8. The central gasket base 7 maintains contact with the lower surface of the eavestrough during thermal expansion and contraction and acts as a barrier protecting the rib seals 8 from accumulated shingle grit. In FIG. 4 it can be seen that the eavestrough sections 30 have expanded and are now in contact with the moulded stop face 22 and in the event that further expansion was necessary, the moulded stop face 22 can first compress and, if necessary, may well shear.

As illustrated in FIG. 3, the ribs 8 are of a height initially greater than the central gasket base 7, however, when the eavestrough section is placed within the fitting, the ribs 8 easily deform while still allowing themselves full flexibility to maintain a seal with the lower section of the eavestrough with both thermal expansion and contraction of the eavestrough section.

The central gasket base 7 performs basically two functions, the first function is a resilient support base assuring that the eavestrough section is snuggly maintained within the fitting, and the second is the central gasket base forms a support surface allowing the ribs 8 to function without the need for providing positive support or primary support of the eavestrough section.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed as defined as follows:

1. An eavestrough fitting comprising a moulded plastic member having secured thereto a gasket, said gasket having at least two ribs extending across said member and up the sides thereof, said ribs being sized to form a seal with an appropriately shaped eavestrough inserted within said fitting, said moulded plastic member having a generally flat base connected to angled sidewalls, said gasket conforming to the shape of said moulded plastic member and including a raised land interior to said ribs, said raised land being of a height relative to said ribs to limit the extent of deformation of said ribs and provide a resilient base for supporting an eavestrough section when the eavestrough section is secured within said fitting, said raised land allowing said eavestrough section interior to said ribs to be in contact with said land on the lower surface of said eavestrough and protect said ribs from grit received in said eavestrough.

2. An eavestrough fitting as claimed in claim 1 wherein said raised land extends up either sidewall of said fitting and serves to center said eavestrough section within said fitting.

3. An eavestrough fitting as claimed in claim 2 wherein said raised land is of a thickness about two thirds of the height of the ribs when uncompressed.

4. An eavestrough fitting as claimed in claim 3 wherein said land is of a length in the direction of the eavestrough section of at least one inch.

5. An eavestrough fitting as claimed in claim 4 wherein said land includes stop tabs on opposite sides of 6. An eavestrough section as claimed in claim 5 wherein said fitting is a joiner fitting and includes ribs either side of said land.

7. An eavestrough fitting as claimed in claim 6 wherein said gasket is injection moulded onto said plastic base.

8. An eavestrough fitting comprising a moulded plastic member having secured thereto a gasket, said gasket having a sealing section and support section, said sealing section being easily deformable and resilient to provide a wiper seal with a section of eavestrough inserted in said fitting, said support section being raised and cooperating with said sealing section to support a section of eavestrough such that said support section deforms to a limited extent providing the primary support for the eavestrough section while the sealing section has deformed to a limited extent such that said sealing section is under less load and maintains sealing contact with the lower surface of an eavestrough section inserted therein.

9. In combination an eavestrough fitting and a length of eavestrough, said fitting comprising a moulded plastic member having secured thereto a gasket, said gasket having a sealing section and support section, said sealing section being easily deformable and resilient to provide a wiper seal with said section of eavestrough inserted in said fitting, said support section cooperating with said sealing section to support said section of eavestrough such that said support section deforms to a limited extent providing the primary support for the eavestrough section while the sealing section has deformed to an extent determined by the sealing requirements as opposed to the support requirements and forms a wiper seal with the lower surface of the eavestrough section.

10. In combination as claimed in claim 9 wherein the durometer of the gasket provides support while accommodating further compression, if required, due to thermal expansion of the eavestrough section.

* * * * *